US008162039B2

(12) United States Patent
Cao et al.

(10) Patent No.: US 8,162,039 B2
(45) Date of Patent: Apr. 24, 2012

(54) FINNED TUBE FOR CONDENSATION AND EVAPORATION

(75) Inventors: Jianying Cao, Shanghai (CN); Zhong Luo, Shanghai (CN); Jian Wu, Shanghai (CN); Yalin Qiu, Shanghai (CN)

(73) Assignee: Wolverine Tube, Inc., Decatur, AL (US)

( * ) Notice: Subject to any disclaimer, the term of this patent is extended or adjusted under 35 U.S.C. 154(b) by 1041 days.

(21) Appl. No.: 12/105,445

(22) Filed: Apr. 18, 2008

(65) Prior Publication Data

US 2008/0196876 A1 Aug. 21, 2008

(51) Int. Cl.
*F28F 1/42* (2006.01)

(52) U.S. Cl. ..... 165/133; 165/184

(58) Field of Classification Search ..... 165/133, 165/184

See application file for complete search history.

(56) References Cited

U.S. PATENT DOCUMENTS

| | | | | |
|---|---|---|---|---|
| 3,171,389 | A | 3/1965 | Throckmorton et al. | |
| 3,753,364 | A | 8/1973 | Runyan et al. | |
| 3,768,290 | A | 10/1973 | Zatell | |
| 4,168,618 | A | 9/1979 | Saier et al. | |
| 4,179,911 | A | 12/1979 | Saier et al. | |
| 4,306,619 | A | 12/1981 | Trojani | |
| 4,313,248 | A * | 2/1982 | Fujikake | 29/890.051 |
| 4,549,606 | A | 10/1985 | Sato et al. | |
| 4,660,630 | A | 4/1987 | Cunningham et al. | |
| 4,729,155 | A | 3/1988 | Cunningham et al. | |
| 4,796,693 | A | 1/1989 | Kastner et al. | |
| 5,333,682 | A * | 8/1994 | Liu et al. | 165/133 |
| 5,513,699 | A | 5/1996 | Menze et al. | |
| 5,697,430 | A * | 12/1997 | Thors et al. | 165/133 |
| 5,775,411 | A | 7/1998 | Schuez et al. | |
| 5,896,660 | A | 4/1999 | Rieger | |
| 6,067,832 | A | 5/2000 | Brand et al. | |
| 6,173,762 | B1 | 1/2001 | Ishida et al. | |
| 6,457,516 | B2 * | 10/2002 | Brand et al. | 165/133 |
| 6,786,072 | B2 | 9/2004 | Beutler et al. | |
| 6,913,073 | B2 * | 7/2005 | Beutler et al. | 165/133 |

(Continued)

FOREIGN PATENT DOCUMENTS

CN 101004337 A 7/2007

OTHER PUBLICATIONS

International Search Report and the Written Opinion of the International Searching Authority for PCT/US08/60776, mailed Aug. 22, 2008.

*Primary Examiner* — Allen Flanigan

(74) *Attorney, Agent, or Firm* — Mark Swanson; Frank M. Caprio; Bradley Arant Boult Cummings

(57) ABSTRACT

A finned tube includes channels defined between adjacent fins on the tube body outer surface. Wings extend from side walls of the adjacent fins between the fin top and the fin base such that the wings form a barrier which splits the channel into an upper channel and a lower channel. A plurality of holes penetrate the barrier where the wings meet, so liquids and gases can pass into and out of the enclosed area defined by the lower channel. The wings can include alternating upper wings and lower wings, and there can be depressions formed in the fin top.

7 Claims, 4 Drawing Sheets

U.S. PATENT DOCUMENTS

| | | | | |
|---|---|---|---|---|
| 6,942,023 | B2 | 9/2005 | Fang et al. | |
| 7,178,361 | B2 | 2/2007 | Thors et al. | |
| 7,243,712 | B2 | 7/2007 | Fay | |
| 7,254,964 | B2 | 8/2007 | Thors et al. | |
| 2003/0168204 | A1 | 9/2003 | Wang | |
| 2007/0034361 | A1 * | 2/2007 | Lu et al. | 165/133 |
| 2007/0131396 | A1 * | 6/2007 | Yu et al. | 165/133 |
| 2007/0151715 | A1 * | 7/2007 | Yunyu et al. | 165/133 |

* cited by examiner

FINNED TUBE FOR CONDENSATION AND EVAPORATION

BACKGROUND OF THE INVENTION

1. Field of the Invention

The current invention describes finned tubes used for heat transfer, such as the tubes used in shell and tube heat exchangers.

2. Description of the Related Art

Finned tubes have been used for heat transfer for many years. Heat flows from hot to cold, so heat transfer is accomplished by conducting heat from a warmer material to a cooler material. There is also heat given off when a material condenses from a vapor to a liquid, and heat is absorbed when a liquid vaporizes or evaporates from a liquid to a vapor. When finned tubes are used for heat transfer, the warmer material is on either the inside or the outside of the tube and the cooler material is on the other side. Usually the tube allows for the transfer of heat without mixing the warmer and cooler materials.

For cooling purposes, a cooling medium can be a liquid such as cooling water flowing through a shell and tube heat exchanger, or it can be a gas such as air blown over a finned tube. Similarly, a heating medium is usually either a liquid or a gas. Finned tubes are sometimes used instead of relatively smooth tubes because finned tubes tend to increase the rate of heat transfer. Therefore, a smaller heat exchanger with finned tubes may be able to transfer as much heat in a given application as a larger heat exchanger with relatively smooth tubes. The design of finned tubes affects the rate of heat transfer and sometimes the tubes are designed differently for specific heat transfer applications. For example, finned tubes used for condensation tend to have different designs than finned tubes used for evaporation.

Examples of the prior art include finned tubes with helical ridges formed on an inner surface of the tube and fins formed on an outer surface of the tube. A channel is defined by adjacent fins on the tube outer surface, and this channel can have a curved, "U" shaped bottom or the channel can have a flat bottom. When used as condensing tubes with the vapor condensing on the outside of the tube and coolant flowing inside the tube, the channels tend to become filled with liquid condensate. The liquid condensate serves to insulate the tube and restrict the cooling needed for further condensation. The flat bottom is preferred because condensate tends to spread out along the bottom of the flat channel instead of creeping up the sides of the fins. This leaves more surface area on the fins free of condensate, which enhances heat transfer.

Finned tubes also have had breaks formed in the fins so condensate flowing within a channel between two fins could flow through a break and enter a different channel. Other finned tubes have had the outer portion of the fin bent over so that a bend is formed part of the way between a base of the fin and a top of the fin. This creates additional angles in the fin which tends to cause the tube to shed liquid condensate more rapidly. When liquid condensate is shed from a tube more rapidly, it tends to enhance heat transfer. Other fins have had notches formed in the fin tip with peaks defined between the notches. In some cases the peaks are bent over to form a curl shape. This again increases curvature and angles in the fin and thereby tends to cause the tube to shed liquid condensate more rapidly.

Some finned tubes are produced by attaching fin material to a relatively smooth tube so the fins are not formed from the material of the tube body. This increases the area available for heat transfer, which does improve heat transfer rates, but the interface between the fin and the tube does cause some resistance to heat flow. The fins attached to the tube can extend radially from a tube axis so they stand straight up from the tube, but they can also be curved or bent in various ways to improve heat transfer.

Some tubes are designed for evaporation on the tube outer surface. For example, fins can be formed on the tube outer surface, and then notches can be depressed into the fin top. Next, the fin is bent over so the fin top touches the adjacent fin such that the bent fin forms a roof over the channel between the two adjacent fins. This produces a cavity which is mostly enclosed between the tube outer surface and two adjacent fins. The notches in the fin top allow liquid to flow into the cavity and vapor to escape from the cavity. There are many designs of finned tubes in existence, but changes which improve heat transfer are still possible.

BRIEF SUMMARY OF THE INVENTION

A tube used for heat transfer has adjacent fins extending from an outer surface of the tube with a channel between the fins. The fins are formed from the material of the tube outer surface, so the fins are monolithic with the tube body. Wings extend from facing side surfaces of the fins between a fin base and a fin top such that the wings form a barrier which splits the channel into an upper and a lower channel. A plurality of holes penetrate the barrier, and the wings can include upper wings and lower wings. The tube can include helical ridges formed on an inner surface of the tube, and the tube can include depressions formed in the fin tops.

DETAILED DESCRIPTION

Figure 1:
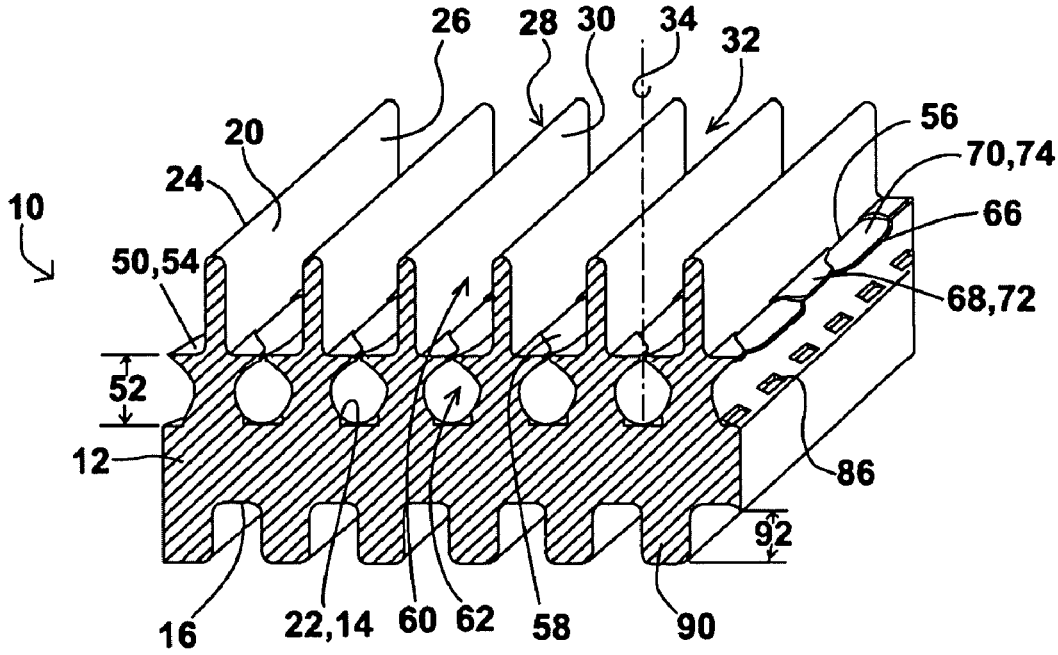
FIG. 1 is a perspective view of a section of the finned tube.

The finned tube of the current invention is intended to be used for heat transfer, and primarily for phase change on the tube outer surface. Generally, heat transfer tubes are designed for either evaporation (boiling) or condensation, but not both. The current invention includes structure desirable for evaporation, and structure desirable for condensation, so the tube can be efficiently used for both types of phase change. The tube is designed to promote a phase change on the tube outer surface, with a heating or cooling medium, such as a liquid, flowing inside the tube. The tube is often utilized in the construction of shell and tube heat exchangers, but other uses are possible.

Heat Transfer Principles

To simplify the following discussion, heat transfer during condensation is discussed. The same basic principles apply to evaporation, except the direction of heat flow is reversed. In the current example, a cooling liquid flowing through the tube interior absorbs the heat of condensation as a vapor condenses on the tube outer surface. The design of the fins on the tube outer surface increase heat transfer by increasing surface area of the tube, and by improving the tube's condensate shedding ability. Other aspects of the tube design also improve heat transfer rates.

When heat is transferred from a condensing vapor on the outside of a tube to a cooling liquid on the inside of a tube, the heat transfer is considered in several distinct steps. The same basic steps apply when heat is transferred through a barrier, such as a tube wall, between any two mediums with different temperatures. This description is directed towards a condensing vapor on the outside of the tube and a cooling liquid on the inside of the tube, but different applications are possible.

The vapor outside the tube has to transfer heat to the cooling liquid inside the tube. As a vapor condenses, a specific amount of heat, referred to as the heat of condensation, is given off. Conversely, as a material is vaporized from a liquid to a gas, a specific amount of heat, referred to as the heat of vaporization, is absorbed. For a specific quantity of a given material, the heat of condensation is the same as the heat of vaporization, except in condensation heat is given off and in vaporization heat is absorbed.

Making reference now to condensation on a tube, there is generally a layer of liquid condensate on the tube outer surface, so the first step is the transfer of heat from the vapor to the condensate on the tube. Heat then flows through the condensate, and condensate often resists heat flow because it acts as an insulator. Even if a liquid is a good conductor of heat, the layer of condensate still provides some resistance to heat flow. After heat flows through the condensate, it is transferred from the condensate to the tube outer surface. There is an interface between the condensate and the tube outer surface, and any interface provides some resistance to heat flow.

Once heat is transferred to the outer surface of the tube, it has to flow from the outer to the inner surface of the tube. To facilitate this heat flow, heat transfer tubes are usually made out of a material which readily conducts heat, or a heat conductor. Copper is one material which is considered to be a good conductor of heat. Generally there is a thin layer of liquid contacting the inner surface of the tube wall which is essentially stagnant. After the heat flows through the tube wall, it must be transferred through the interface between the inner surface of the tube wall to the adjacent layer of cooling liquid inside the tube. Heat then has to flow through this thin layer of liquid adjacent to the tube wall to the main body of flowing liquid in the tube.

The more turbulent or rapid the flow of liquid within the tube, the thinner the layer of stagnant liquid sitting next to the tube wall. Therefore, tube designs which cause mixing or agitation of the liquid within the tube provide a benefit. Turbulent flow causes mixing of the liquid, as compared to laminar flow, and higher liquid flow rates can increase turbulence. Features of the tube inner surface can also increase the turbulence and mixing of the liquid inside the tube. Heat transferred to the flowing liquid in the tube is then carried away as the liquid exits the tube.

An interface between the fins and the tube exists if the fins are constructed separately from the tube, and then attached. This is true if the fin and tube are constructed of the same material, such as copper, or from different materials. Any interface causes some resistance to heat flow. If the fins are formed from the tube wall, there is no interface and heat flow is improved. In this discussion, fins formed from the tube wall are referred to as being monolithic with the tube, and it is preferred that fins be monolithic with a tube to minimize resistance to heat flow.

The tube should be made from a malleable substance so the fins can be formed from the tube without cracks or breaks forming in the tube wall. Cracks or breaks limit the structural integrity and strength of a tube, and can also provide resistance to heat flow. Generally these tubes are used in shell and tube heat exchangers, and the ends of the tubes are affixed in tube sheets of the heat exchanger. A malleable tube can be easier to install in a heat exchanger tube sheet. The tube should also be constructed from a material which readily conducts heat. Copper is often used in tube construction because of its malleability and heat conducting properties.

Special Condensation Considerations

Finned tubes have design considerations specifically related to the collection of condensate on the tube outer surface. Some tubes are better at shedding the condensate than others. If condensate is shed more rapidly, the layer of condensate on the tube is thinner and there is less resistance to heat flow. Therefore, a condensation tube that more rapidly sheds condensate tends to be preferred because it provides a more rapid heat flow.

One aspect that causes a tube to shed condensate more quickly is the ability of the outer surface to concentrate the condensate into drops. This is frequently done by having sharp points or curves on the outer surface. If a sharp point or curve is concave in nature, it tends to act as an accumulation site for condensate drops because surface tension tends to cause the condensate to collect in concave surface features. Condensate tends to avoid convex surfaces because surface tension effects tend to pull the condensate away from these areas. Therefore, convex areas tend to remain relatively free of condensate and have less resistance to heat flow. Concave areas tend to concentrate condensate into drops which can then more rapidly fall from the tube, so the tube sheds condensate more quickly. Curves or sharp points generally produce both convex and concave surfaces at different locations.

It is also true that the more surface area on a condensing tube, the more rapid the flow of heat. When fins are formed on a tube it increases the surface area of the tube, which serves to increase the rate of heat transfer across the tube. Other deformations in the tube outer surface which increase surface area will also tend to increase the rate of heat transfer.

Special Evaporation Principles

Evaporation tubes have specific design features which are different than those features preferred for a condensation tube. Evaporation tubes are typically immersed in the liquid to be evaporated, so condensate shedding ability is not relevant. Factors which can enhance evaporation include providing a nucleation site for the initial formation of bubbles, providing enclosed areas where liquid can be superheated, and providing holes or access ports to the enclosed areas where vapor can escape and more liquid can be introduced.

Nucleation sites for boiling are often very small imperfections or sharp points on the boiling surface. An enclosed area on a tube provides for a relatively small quantity of liquid to be essentially surrounded by heat transferring surfaces from the finned tube, so the amount of heat transfer surface area per volume of liquid is large. This allows for the liquid to be rapidly heated to facilitate boiling or vaporization. Vapors are less dense than liquids, so when a liquid vaporizes it expands. If the vaporizing liquid is enclosed, it produces pressure as it vaporizes. Vapors also expand as they are heated, so heating of a vapor in an enclosed area also increases pressure.

Small holes in the enclosed area allow for the small quantity of liquid to escape after is has vaporized, and the pressure from vaporization tends to push the vapor out of the hole. Normally, surface tension would reduce liquid flow through small holes, unless there is a large enough pressure difference to force or push the liquid through the hole. The escaping vapor leaves a reduced pressure in the enclosed area, which draws liquid in through the small holes after the vapor has escaped, and the process repeats. This serves as a sort of pumping action, where liquids are drawn into enclosed area, vaporized, and pushed out of the enclosed areas.

Finned Tube Main Body

Figure 2:
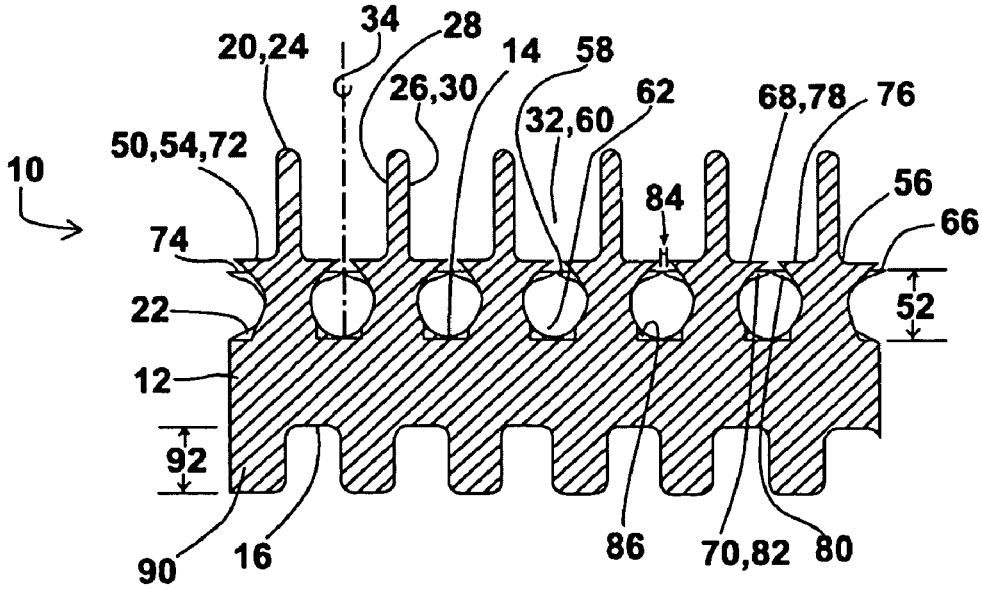
FIG. 2 is a side sectional view of the finned tube.
Figure 3:
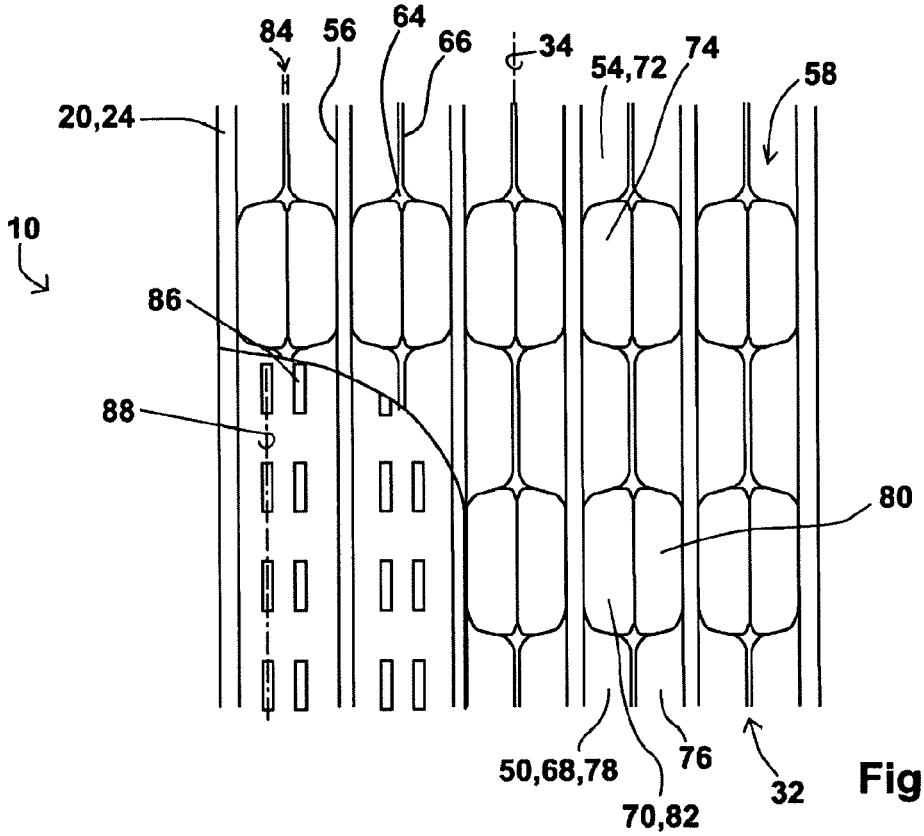
FIG. 3 is a top view of the outer surface of the tube, with a cutout section showing the tube outer surface underneath the wings.

One embodiment of the finned tube 10 of the current invention is shown in different perspectives in FIGS. 1, 2 and 3. This discussion focuses on the embodiment shown, but this discussion is not intended to be limiting. Other embodiments are possible, and will be apparent to one skilled in the art.

The tube 10 includes a main body 12 which has an outer surface 14 and an inner surface 16. The main body 12 is the base for any shapes or structures on the outer or inner surface 14, 16. This main body 12 should be made of a material which conducts heat readily. Metals are generally good conductors and are frequently used for the construction of tubes of the current invention. Copper is a particularly common metal used for tube 10 construction, but aluminum, other metals, various alloys and even non-metallic materials are also possible. The material should also be malleable such that the various structures on the inner and outer surface 14, 16 can be formed without damaging the integrity of the tube body 12. This allows for the structures to be formed from the tube body 12, which results in the structures being monolithic with the tube body 12.

Tube Fins

The tube 10 has at least one fin 20 formed on its outer surface 14. The fin 20 generally protrudes or extends circumferentially from the tube body outer surface 14, and is usually helical. The tube 10 often has ends without any fins 20, which facilitate forming a seal between a tube end and a heat exchanger tube sheet. These ends are generally smooth. There is typically some transition area between the smooth ends and the finned portion of the tube 10.

It is possible that one single fin 20 is helically wound around the entire length of the finned portion of the tube 10. It is also possible that there will be a plurality of fins 20 helically winding around the tube 10. In either case, when looking at a section of the tube body outer surface 14, it will appear as though there are several adjacent circumferential fins 20 protruding from the tube body outer surface 14. When viewed along the axial direction of the tube 10, fin 20 sections next to each other are referred to as adjacent fins 20, despite the fact that they might be the same fin 20 helically wrapping around the tube body outer surface 14. The fin 20 is formed from the material of the tube body 12, so the fin 20 is monolithic with the tube body 12.

Each fin 20 has several parts including a fin base 22, a fin top 24, and a fin side wall 26. The fin base 22 is at the point where the fin 20 connects to the tube body outer surface 14. The fin top 24 is opposite the fin base 22 and is the highest point of the fin 20 relative to an axis of the tube 10. A fin side wall 26 includes a left side wall 28 and a right side wall 30 opposite the left side wall 28. A channel 32 is defined between two adjacent fins 20 over the tube body 12, and the channel 32 has a channel center 34. The channel center 34 is equidistant from the two adjacent fins 20 which form the channel 32. The fin 20 can be approximately perpendicular to the tube body 12 such that the fin 20 extends essentially straight out from the tube body outer surface 14. In such a case, the fin 20 would extend radially from the tube 10. It is also possible for the fin 20 to be positioned at other angles to the tube body outer surface 14.

Figure 4:
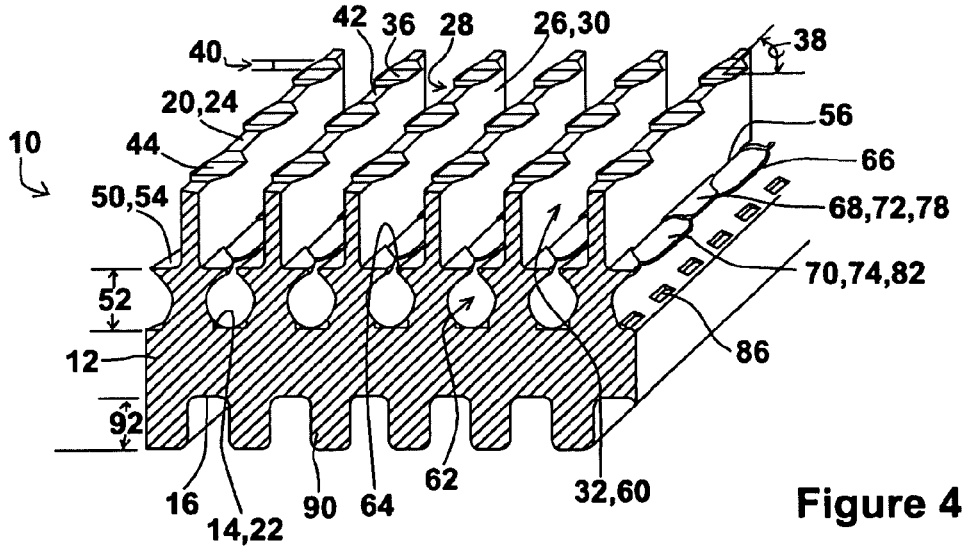
FIG. 4 is a perspective view of a section of the finned tube with depressions in the fin top.
Figure 5:
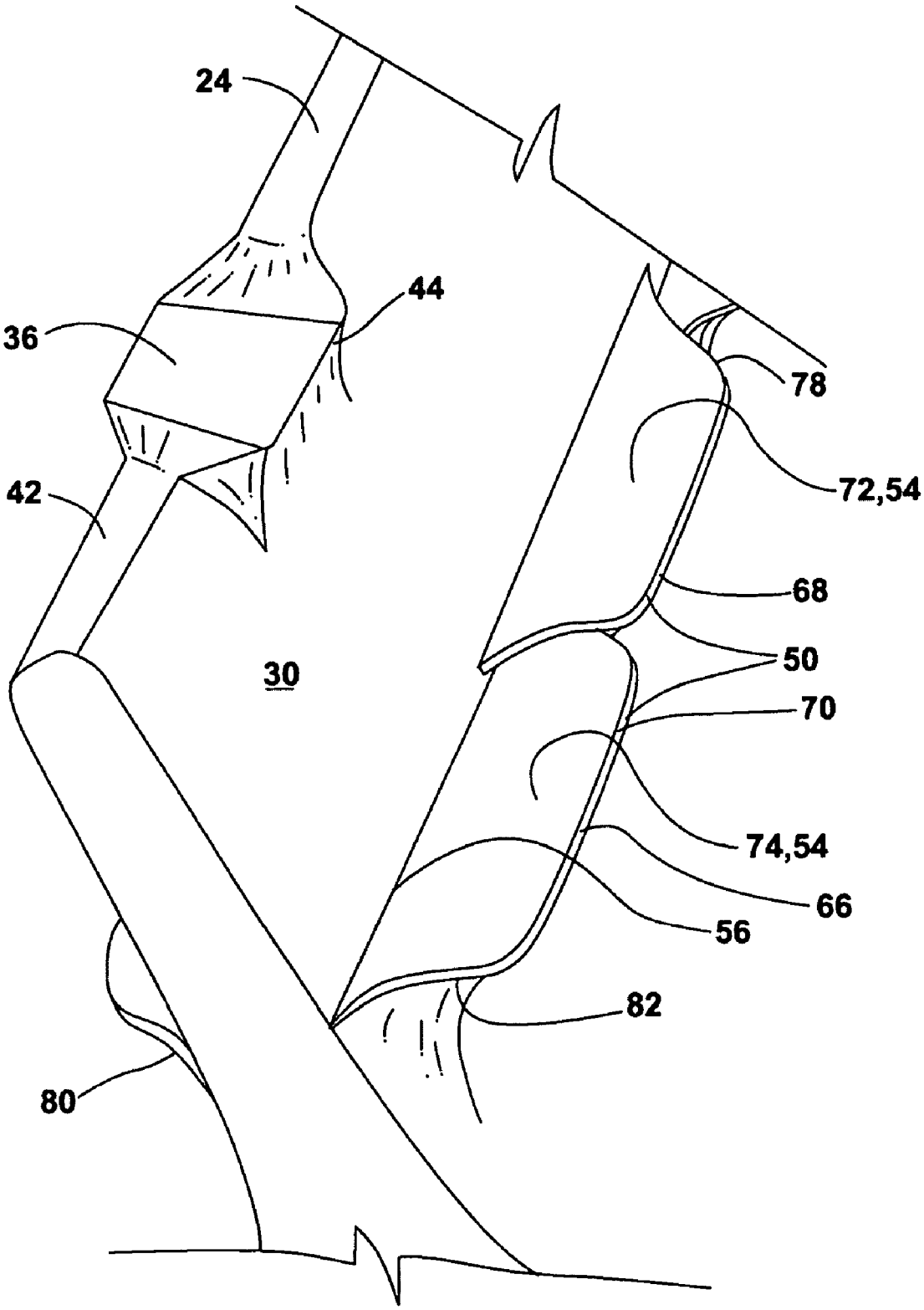
FIG. 5 is a perspective, close up view of a section of one fin.
Figure 6:
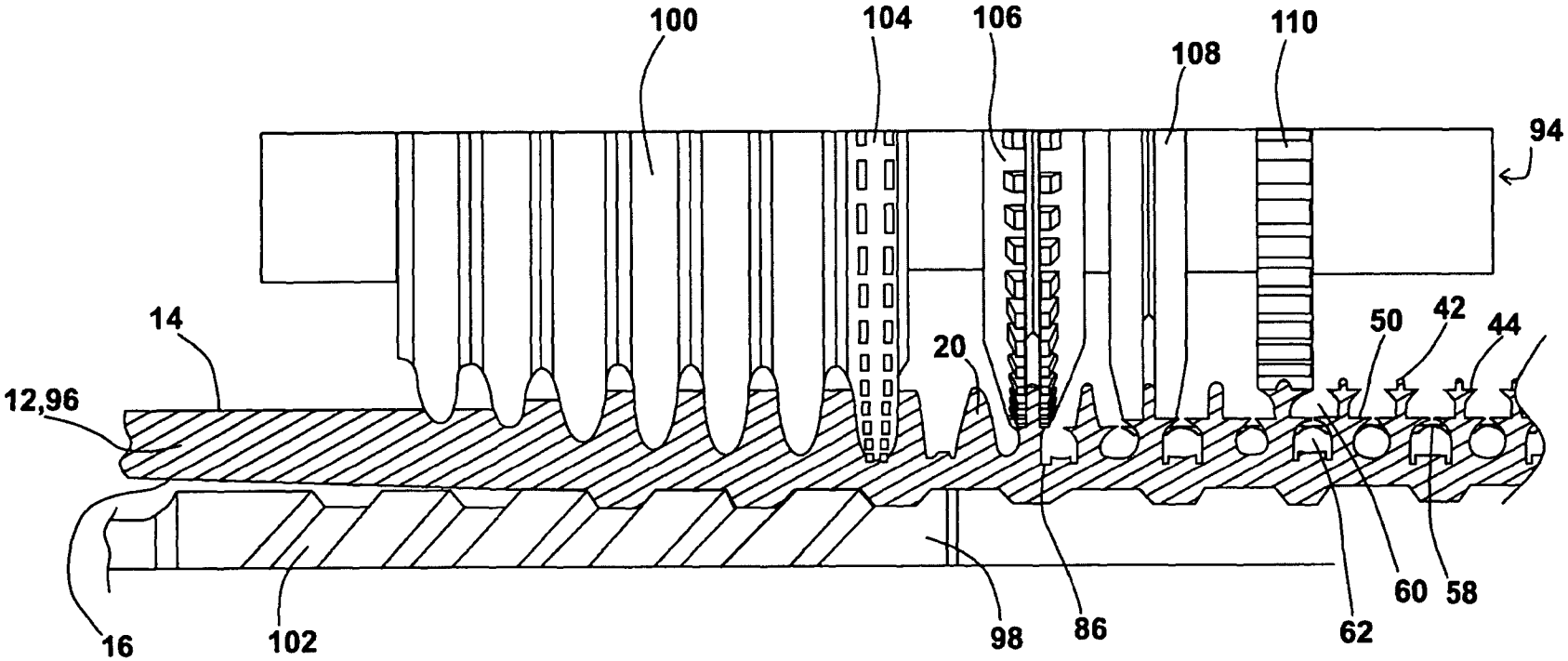
FIG. 6 is a side view of an arbor and inner support with a sectional view of a tube side wall between the arbor and inner support.

The fin top 24 can have a plurality of depressions 36, as best seen in FIGS. 4 and 5. The depressions 36 have a skew angle 38 which is defined by the angle of the depression 36 relative to the fin top 24. The skew angle 38 can range between 0 to 90° such that the depression 36 can be perpendicular to the fin 20 or the depression 36 can be set at a different angle to the fin 20. The depression has a depth 40 which generally ranges between 0.1 to 0.5 millimeters. A plurality of peaks 42 are defined between adjacent depressions 36. When depressions 36 are formed in the fin top 24, a platform 44 can be formed extending from the fin top 24. The platform 44 extends from the fin top 24 at the depressions 36. The platform 44 is at the fin top 24 because the fin top 24 undulates up and down with the depressions 36 and peaks 42. The plurality of platforms 44 provides additional curvature, angles, and surface area in the fin 20.

Wings

Referring now to FIGS. 1, 2, 3 and 5, the fin 20 includes a wing 50 extending or protruding from the fin side wall 26 between the fin top 24 and the fin base 22. The wing 50 can be positioned near the middle of the side wall 26, closer to the fin top 24, or closer to the fin base 22, but not at the fin top 24 or the fin base 22. The wing 50 can be approximately perpendicular to the fin side wall 26 or it can be set at other angles to the fin side wall 26. The wing has a height 52 defined as the distance from the fin base 22 to a wing upper surface 54. If the wing 50 is set at an angle other than 90° to the fin side wall 26, the wing height 52 is defined as the distance from the fin base 22 to the highest point on the wing upper surface 54.

The wing 50 has a wing base 56 at the point where the wing 50 connects to the fin side wall 26. Generally, the wing base 56 is approximately parallel to the fin base 22, but it is possible for the wing base 56 to be at an angle which is not parallel with the fin base 22. The wing 50 extends from the side wall 26 to approximately the channel center 34. Wings 50 extend from both the fin left side wall 28 and the right side wall 30 such that wings 50 from adjacent fins 20 each reach into the channel 32 defined between the adjacent fins 20. The wings 50 extending into the channel 32 form a barrier 58 which divides the channel 32 into an upper channel 60 above a lower channel 62. The barrier 58 over the lower channel 62 is not absolute, but generally provides for an enclosed area protected from liquids freely flowing into and out of the enclosed area. The wings 50 define holes 64 where the wings 50 meet. Smaller holes 64 are better than larger holes 64 for preventing the free flow of liquids, but the holes 64 can be too small. The wings 50 have a wing terminus 66 opposite the wing base 56, so holes 64 can be positioned between the terminuses 66 of facing wings 50 extending into the same channel 32.

In one embodiment, the wings 50 on one fin side wall 26 include alternating upper wings 68 and lower wings 70. The upper wing 68 upper surface 72 is higher than the lower wing 70 upper surface 74, so the wings 50 make a crenellated pattern along a single fin side wall 26, similar to the pattern on top of a castle wall. The upper wing 68 upper surface 72 is higher than the lower wing 70 upper surface 74 because the upper wing 68 upper surface 72 is further from the tube body outer surface 14 than the lower wing 70 upper surface 74, regardless of whether the wings 50 are on the top or bottom of the tube 10. Because the fin 20 has a left and right side wall 28, 30, the wings 20 are further described as left wings 75 and right wings 77. Accordingly, the upper wing 68 is further described as the left upper wing 76 and the right upper wing 78, and the lower wing 70 is further described as the left and right lower wing 80, 82 respectively. Therefore, the barrier 58 is formed from left and right wings 75, 77 extending from adjacent fins 20.

The left and right upper wings 80, 82 and the left and right lower wings 76, 78 can be aligned, so the left and right lower wings 80, 82 terminus' 66 face each other approximately at the channel center 34, and the left and right upper wings 76, 78 terminus' 66 also face each other approximately at the channel center 34. The left and right lower wings 80, 82 can touch at approximately the channel center 34, to better form the barrier 58 over the lower channel 62. The left and right upper wings 76, 78 can also touch at approximately the channel center 62, but there may also be a gap 84 between the upper wings 76, 78. This gap 84 serves as a hole 64 in the barrier 58. It is also possible for the upper and lower wings 68, 70 to be staggered, so a left upper wing 76 would face a right lower wing 82 approximately at the channel center 34, and vice versa. Another possibility is for the position of the upper and lower wings 68, 70 on facing fin side walls 26 to be random, with no particular order relative to each other.

The holes 64 defined by the wings 50 are generally located at points where the wings 50 intersect. Holes 64 may exist where upper and lower wings 68, 70 meet along a single fin side wall 26, and holes 64 may exist where fins 20 meet at approximately the channel center 34. Holes 64 are particularly common where three or more wings 50 meet, such as if the left and right upper and lower wings 76, 78, 80, 82 all essentially meet at approximately the same point. Holes 64 can be long, such as if the left and right upper wings 76, 78 do not touch at approximately the channel center 34.

The size of the holes 64 should not be too large, or the barrier 58 will be less effective at forming an enclosed area. The enclosed area formed by the barrier 58, two adjacent fins 20, and the tube body outer surface 14 promotes superheating of liquids and nucleate boiling, which significantly increases the rate of boiling. However, some holes 64 are desired to allow vapor to escape and liquid to enter the enclosed area, so the size of the hole 64 should not be too small. The holes 64 should be less than 0.2 square millimeters, and preferably between 0.01 and 0.2 square millimeters. If the holes 64 are too large, the wings 50 will not serve as a barrier 58, and the rate of boiling will be significantly reduced. In fact, if the holes 64 are too large, the wings 50 merely project into the channel 32 and do not form a barrier 58. The size of the hole 64 can be varied to better accommodate specific materials for evaporation, so a tube can be customized somewhat for particular uses or materials. Examples of other factors which can be designed for particular materials include the wing height 52 and the spacing between adjacent fins 20. Preferably, the holes 64 should not account for more than about 10% of the area of the barrier 58.

The upper channel 60 is defined by the barrier 58 on the bottom and adjacent fin side walls 26 on either side. The upper channel 60 is considered open because the top is relatively open, such that liquids can freely flow into and out of the upper channel 60. There can be projections across portions of the top of the upper channel 60, but the top should include larger holes which are better suited to allow the free flow of liquid. The platforms 44 at the depressions 36 do form projections over the upper channel 60, but the platforms 44 do not form a barrier 58. The top of the upper channel 60 can include a continuous opening, or at least holes 64 large enough to allow liquids to flow through. Preferably, the top of the upper channel 60 is no more than about 50% blocked by solid structure, and there are openings larger than 0.2 square millimeters into the upper channel 60.

The barrier 58 splits the channel 32 into an upper channel 60 and a lower channel 62. The design of the lower channel 62 is well suited for evaporation, and the design of the upper channel 60 is well suited for condensation. The lower channel 62 does not significantly hinder condensation, and may be beneficial to some degree. The upper channel 60 does not significantly hinder evaporation, and may be beneficial to some degree. This provides a finned tube 10 which is effective for both evaporation and condensation phase transfer.

Channel Mark

Channel marks 86 can be formed on the tube body outer surface 14 within the fin channel 32. Channel marks 86 are basically a recess defined in the tube body outer surface 14. The channel mark 86 can be continuous or intermittent, wherein a continuous channel mark 86 would be basically a groove of some shape formed circumferentially around the tube 10 within the fin channel 32, and intermittent channel marks 86 would be a plurality of discreet depressions defined in the fin channel 32. The channel marks 86 shown are intermittent. The channel marks 86 can be formed basically in a line, so that the channel marks 86 define a channel line 88. The channel line 88 can be approximately parallel with the fin channel 32 or the fin base 22, or the channel line 88 can meander within the channel 32. The channel line 88 is defined by the row of channel marks 86.

There can be one channel line 88 or a plurality of channel lines 88 within one fin channel 32. The channel lines 88 can be at or near the channel center 34, they can be offset from the channel center 34 near the fine base 22, or they can be anywhere in between. If there are two or more channel lines 88 and the channel marks 86 are intermittent, the channel marks 86 can be simultaneous or alternating. If the channel marks 86 are simultaneous, they will be aligned directly across from each other, as shown. If the channel marks 86 are alternating, they will be aligned such that the channel marks 86 in one channel line 88 are not directly across from channel marks 86 in another channel line 88 within the same fin channel 32.

The channel marks 86 can have a multitude of shapes. They can be square, rectangular, trapezoidal, polygonal, triangular or almost any other shape. The channel marks 86 serve as nucleation sites for evaporation, and may also serve as nucleation sites for condensation. The sharp edges and corners of the channel marks 86 provide imperfections where a bubble can begin forming during vaporization. The sharp corners or angles of the channel marks 86 may also aid in drop formation because they provide an accumulation site for condensate. The channel marks 86 also increase surface area, which helps with heat transfer. The channel marks 86 can extend into the tube body 12 and therefore they can reduce the strength of the tube 10 by reducing the thickness of the tube body 12. Therefore, the channel marks 86 and channel line 88 can be positioned near the fin base 22, where the thickness of the tube body 12 can be larger.

Inner Surface Ridges

Heat transfer across the tube 10 can be improved by providing better transfer of heat between the tube body inner surface 16 and a liquid within the tube 10. Ridges 90 can be defined on the tube body inner surface 16 to help facilitate more rapid heat transfer. The ridges 90 on the inner surface 16 are generally helical and have a depth 92 and a frequency. The frequency is the number of ridges 90 within a set distance. The ridges 90 are also set at different cut angles relative to the tube axis. The depth 92 and the frequency of the ridges 90 can vary, and the cut angle can be set to cause the cooling liquid to swirl within the tube 10. A swirling liquid tends to increase heat transfer by increasing the amount of agitation within the cooling liquid.

Tube Forming Process

Finned tubes 10 are generally formed from relatively smooth tubes 10 with a tube finning machine, which is well known in the industry. The tube finning machine includes an arbor 94 as seen in FIG. 5, with continuing reference to FIGS. 1, 2, and 3. Frequently, a tube finning machine will include three or more arbors 94 positioned around the tube 10, so the tube 10 is held in place by the arbors 94. The arbors 94 are positioned and angled such that each complements the others. A tube is provided and fed through the finning machine such that a tube wall 96 is positioned between the arbor 94 and an inner support 98. The arbor 94 deforms the tube outer surface 14, and the inner support 98 can deform the tube inner surface 16. Actually, the arbors 94 hold various tools or discs, and the tools contact and shape the tube outer surface 14, so the arbors 94 serve as a form of tool holder. The tube wall 96 is generally rotated relative to the arbor 94 and moves axially with the inner support 96 as it rotates.

The arbor 94 generally includes several fin forming discs 100 which successively deform the tube wall 96 to form one or more helical fins 20 on the tube outer surface 14. Successive finning discs 100 tend to project deeper into the tube wall 96 such that fins 20 are formed and pushed upwards by the finning discs 100. The inner support 98 can include recesses 102 such that helical ridges 90 are formed on the tube inner surface 16 as fins 20 are formed on the tube outer surface 14.

After the finning discs 100 have formed the fins 20, various other discs can be included on the arbor 94 to further deform and define aspects of the final tube 10. These remaining discs can be included or excluded, as desired. After the finning discs 100, the channel mark disc 104 can be used to form channel marks 86 in the channel 32 defined by adjacent fins 20. After the channel mark disc 104, one or more wing forming discs 106 can be used to form wings 50 on the fin side surfaces 28 between the fin base 22 and the fin top 24. The wing forming disc 106 forms the wings 50 which can later become the lower wings 70. After the wing forming disc 106, one or more wing depression discs 108 form the upper wings 68 such that the fin side wall 26 includes alternating upper and lower wings 68 which define a barrier 58 making an upper and lower channel 60, 62. Next, a depression forming disc 110 can be mounted on the arbor 94. The depression forming disc 110 creates depressions 36 in the fin top 24. In this manner, the various deformations of the original relatively smooth tube 10 are produced. There are other possible orders and designs of discs and tools which can be used to achieve similar results.

Tube Benefits

The tube 10 as described is effective for use both as an evaporating tube and a condensing tube. The tube 10 can be used for other purposes, but it is particularly useful as a dual condensation and evaporation tube 10. Some heat transfer applications, such as certain heat pumps, require a heat exchanger to be used successively for evaporation of a liquid and for condensation of a vapor. The general design of most evaporation tubes is different than for most condensation tubes, and vice versa, so a dual function tube has benefits. The tube 10 outer surface is generally used for the phase change, with a cooling or heating medium, usually a liquid, flowing inside the tube 10.

When used for condensing a vapor on the outside surface 14 with a cooling liquid passed through the tube interior, the upper channel 60 is the most beneficial. Condensation is facilitated because the outer surface 14 has fins 20 to increase surface area, and also lots of angles and sharp corners. These angles and sharp corners provide areas where surface tension tends to cause the condensate to form into drops. When these drops are formed, they fall off the tube 10 more readily, so the tube 10 sheds condensate more quickly. Both the upper and lower channels 60, 62 between the fins 20 facilitate flow of the condensate, which improves the rate at which drops escape or fall from the tube 10. This also improves the condensate shedding ability of the current invention.

The fins 20, wings 50, depressions 36, platforms 44, and channel marks 70 all add surface area to the tube outer surface 14. Heat flows across a surface, so more surface area tends to increase the rate of heat flow. Therefore, any formations on the tube outer surface 14 which increase surface area tend in increase the rate of heat flow.

For evaporation, the lower channel 62 provides the most benefit, but the surface area and sharp corners of the upper channel 60 can also be beneficial. Liquid is superheated in the enclosed area defined by the barrier 58, adjacent fins 20, and the tube body outer surface 14. The large surface area of the enclosed area surrounds a relatively small volume which is filled with liquid, so significant heat is rapidly transferred to the enclosed liquid. This causes the enclosed liquid to superheat and boil. The channel marks 86 also serve as nucleation sites in the enclosed area, which further facilitates the boiling of the liquid.

Liquid enters the enclosed area of the lower channel 62 through the holes 64 in the barrier 58. As the liquid vaporizes, the volume expands and pressure forces the vapor out of the holes 64. The escaping vapor leaves a low pressure in the lower channel 62 and the enclosed area, which draws more liquid in to repeat the process. There should be holes 64 located regularly along the length of the barrier 58 to allow vapors and liquids to pass, so the entire lower channel 62 serves as an enclosed area for evaporation. If the holes 64 did not penetrate the barrier 58 regularly, it is possible liquid would not be able to flow to portions of the lower channel 62 before vaporizing, which would limit the evaporative efficiency of the tube 10. The alternating upper and lower wings 68, 70 provide for many wing intersections, which produce many locations for holes 64 along the length of the barrier 58 and facilitate the evaporative effectiveness of the tube 10.

The angles and sharp points in the upper channel 60 can serve as nucleation sites for boiling, and the large surface area aids in heat transfer to the liquid, so the upper channel 60 does facilitate the evaporative process. The upper channel 60 doesn't have an enclosed area, so the evaporative efficiency is not as large as for the lower channel 62, but the upper channel 60 does not hinder the evaporation process.

The tube inner surface 16 also promotes heat transfer because the ridges 74 can cause turbulence and swirling of the cooling liquid. This turbulence and swirling cause a mixing which minimizes laminar flow, and also tends to minimize the depth of the liquid layer directly adjacent to the tube inner surface 16. The ridges 74 also increase the surface area of the inner surface 16, which facilitates heat transfer. A higher ridge frequency and/or a larger ridge depth 76 tends to increase heat transfer rates, but higher ridge frequencies and/or deeper ridges 74 also tend to increase resistance to flow of the cooling liquid through the tube 10. A lower flow rate of cooling liquid can slow heat transfer. Therefore, a balance must be struck for the best heat transfer conditions.

Example Dimensions

The dimensions of the current invention can vary, but example dimensions are provided below which will give the reader an idea as to at least one embodiment of the current invention.

The inter-fin distance is the distance between a center point of two adjacent fins 20 and this distance can be between 0.3 and 0.7 millimeters.

The fin 20 has a thickness above the wing 50 which is referred to as the fin thickness, and this thickness can be between 0.05 and 0.3 millimeters.

The fin 50 has a height measured from the fin base 22 to the fin top 24, where the fin top 24 would be measured at a peak 42 if the fin had depressions 36, and the fin height can be between 0.5 and 1.5 millimeters.

The wing 50 has a height 52 measured from the tube body outer surface 14 to the wing upper surface 54. The lower wing height 52 can be 0.15 to 0.5 millimeters, and the upper wing height 52 can be 0.2 to 0.6 millimeters, with the difference in wing height 52 between the upper and lower wings 68, 70 being 0.02 to 0.2 millimeters.

The channel marks 70 have several dimensions. They have a length which is measured along the circumference of the tube 10, and this length can be between 0.1 and 1 millimeter. The channel mark 70 has a width which is measured along the axis of the tube 10, and this width can be between 0.1 and 0.5 millimeters. The channel mark 70 also has a depth which can be between 0.01 and 0.2 millimeters.

The depression 36 formed in the fin top 24 has a depth 40 which can vary between 0.1 and 0.5 millimeters, and the depression 36 has a width which can vary between 0.1 and 1 millimeter.

The ridge 74 formed on the tube body inner surface 16 has a height, and this height can be between 0.1 and 0.5 millimeters. The internal ridge angle with the axis can be set at 46°, and the ridge starts can vary between 8 and 50.

The width of the upper wing 68 measured circumferential to the tube 10 along the wing base 56 can be between 0.1 and 1 millimeter, and the width of the lower wing 70 can also be between 0.1 and 1 millimeter.

The hole 64 defined in the barrier 58 can have an area between 0.01 and 0.2 square millimeters.

While the invention has been described with respect to a limited number of embodiments, those skilled in the art, having benefit of this disclosure, will appreciate that other embodiments can be devised which do not depart from the scope of the invention as disclosed here. Accordingly, the scope of the invention should be limited only by the attached claims.

We claim:

1. A finned tube comprising:

a tube body having an outer surface;

a fin extending from the tube body outer surface, wherein the fin is monolithic with the tube body and the fin includes a fin top, a fin base, and a fin side wall;

a plurality of wings having a wing upper surface, the wings extending from the fin side wall between the fin top and the fin base, wherein the wings further comprise a plurality of alternating upper wings and lower wings and wherein the upper wing upper surface is further from the tube body outer surface than the lower wing upper surface; and a plurality of peaks on the fin top, wherein adjacent peaks define a depression on the fin top, and wherein a platform extends from the fin top at the depression.

2. The finned tube of claim 1 wherein the fin further comprises adjacent fins, wherein upper wings of adjacent fins are aligned and the lower wings of adjacent fins are aligned.

3. The finned tube of claim 1 wherein the fin further comprises adjacent fins defining a channel between the adjacent fins, wherein the fin side wall further comprises a left fin side wall and a right fin side wall, wherein the wings further comprise left wings extending from the left fin side wall and right wings extending from the right fin side wall, and wherein the left and right wings form a barrier such that the channel is divided into an upper channel and a lower channel.

4. The finned tube of claim 3 wherein the wings define holes penetrating the barrier.

5. The finned tube of claim 4 wherein the holes have a maximum area of 0.2 square millimeters, and wherein the upper channel is open.

6. The finned tube of claim 1 further comprising a channel mark in the channel on the tube body outer surface.

7. The finned tube of claim 1 wherein the tube body further comprises an inner surface, the finned tube further comprising ridges on the tube body inner surface.

* * * * *